US010096290B2

(12) United States Patent
Na et al.

(10) Patent No.: US 10,096,290 B2
(45) **Date of Patent: *Oct. 9, 2018**

(54) DISPLAY APPARATUS, METHOD OF DRIVING THE SAME AND VISION INSPECTION APPARATUS FOR THE SAME

(71) Applicant: Samsung Display Co., Ltd., Yongin-si (KR)

(72) Inventors: Jong-Hee Na, Asan-si (KR); Hoi-Sik Moon, Asan-si (KR); Kang-Hyun Kim, Seoul (KR); Woo-Jin Jung, Asan-si (KR); Jae-Seob Chung, Asan-si (KR); Jung-Suk Han, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/839,023

(22) Filed: Dec. 12, 2017

(65) Prior Publication Data

US 2018/0102099 A1 Apr. 12, 2018

Related U.S. Application Data

(63) Continuation of application No. 14/790,927, filed on Jul. 2, 2015.

(30) Foreign Application Priority Data

Dec. 10, 2014 (KR) ..... 10-2014-0177692

(51) Int. Cl.
*G09G 3/36* (2006.01)
*G09G 3/20* (2006.01)

(52) U.S. Cl.
CPC ..... *G09G 3/3607* (2013.01); *G09G 3/20* (2013.01); *G09G 3/2003* (2013.01); *G09G 3/36* (2013.01);

(Continued)

(58) Field of Classification Search
None
See application file for complete search history.

(56) References Cited

U.S. PATENT DOCUMENTS 8,619,102 B2 12/2013 Chen et al.
8,913,092 B2 12/2014 Ha et al.
(Continued)

FOREIGN PATENT DOCUMENTS

KR 10-2008-0092581 10/2008
KR 10-2010-0030647 3/2010
(Continued)

OTHER PUBLICATIONS

European Search Report issued by European Patent Office dated Jun. 3, 2016, in connection with European Patent Application No. 15196658.7, which also clams Korean Patent Application Serial No. 10-2014-0177692 as its priority document.
(Continued)

*Primary Examiner* — Carl Adams
(74) *Attorney, Agent, or Firm* — H.C. Park & Associates, PLC

(57) ABSTRACT

A method of driving a display apparatus including generating first gamma correction data of input data using a first gamma look-up table ("LUT"), determining a Mura correction value of the first gamma correction data, adding the Mura correction value to the input data to generate added input data, generating second gamma correction data of the added input data using the first gamma LUT, and driving a pixel in the display panel using the second gamma correction data of the added input data. The Mura correction value is determined after the gamma correction data is generated, and the generating of the added input data is performed prior to any gamma correction being performed on the input data.

5 Claims, 10 Drawing Sheets

(52) U.S. Cl.
CPC ..... *G09G 2310/027* (2013.01); *G09G 2320/0233* (2013.01); *G09G 2320/0242* (2013.01); *G09G 2320/0276* (2013.01); *G09G 2320/0285* (2013.01); *G09G 2320/0295* (2013.01); *G09G 2320/041* (2013.01); *G09G 2320/0666* (2013.01); *G09G 2320/0673* (2013.01); *G09G 2320/0693* (2013.01); *G09G 2360/145* (2013.01)

(56) References Cited

U.S. PATENT DOCUMENTS

| | | | | |
|---|---|---|---|---|
| 9,007,408 | B2 | 4/2015 | Jeon et al. | |
| 2002/0063701 | A1 | 5/2002 | Sano et al. | |
| 2004/0246273 | A1* | 12/2004 | Rykowski | G09G 5/06 345/690 |
| 2005/0140584 | A1 | 6/2005 | Kim et al. | |
| 2010/0013751 | A1* | 1/2010 | Kerofsky | G09G 3/006 345/89 |
| 2010/0201887 | A1 | 8/2010 | Bakhmutsky | |
| 2011/0141149 | A1 | 6/2011 | Inoue et al. | |
| 2011/0234644 | A1 | 9/2011 | Park et al. | |
| 2014/0198134 | A1 | 7/2014 | Moon et al. | |
| 2015/0070403 | A1 | 3/2015 | Kim et al. | |

FOREIGN PATENT DOCUMENTS

| | | |
|---|---|---|
| KR | 10-2012-0092982 | 8/2012 |
| KR | 10-2013-0090211 | 8/2013 |
| KR | 10-2014-0093011 | 7/2014 |
| KR | 10-2015-0030013 | 3/2015 |
| KR | 10-2015-0081085 | 7/2015 |

OTHER PUBLICATIONS

Non-Final Office Action dated Oct. 6, 2016, in U.S. Appl. No. 14/790,927.
Final Office Action dated May 11, 2017, in U.S. Appl. No. 14/790,927.
Notice of Allowance dated Sep. 13, 2017, in U.S. Appl. No. 14/790,927.

* cited by examiner

| GRAY | | | |
|---|---|---|---|
| RGB | Rc | Gc | Bc |
| ... | ... | ... | ... |
| n | n+ΔRGn | n+ΔGGn | n+ΔBGn |
| ... | ... | ... | ... |

<RGB-GAMMA LUT>

| GRAY | | | |
|---|---|---|---|
| RGB | RED_M | GREEN_M | BLUE_M |
| ... | ... | ... | ... |
| n | Δ RAn | Δ GAn | Δ BAn |
| ... | ... | ... | ... |

<MURA CORRECTION LUT>

FIG. 5A

<COMPARATIVE EXAMPLE EMBODIMENT_ RGB-GAMMA LUT>

| GRAY | RED | GREEN | BLUE |
|---|---|---|---|
| 0 | | | |
| 1 | | | |
| 2 | | | |
| ... | ... | ... | ... |
| 22 | | | |
| 23 | 25 | 24 | 28 |
| 24 | | | |
| 25 | | | |
| 26 | | | |
| 27 | | | |
| 28 | | | |
| ... | ... | ... | ... |
| 255 | | | |

FIG. 5B

<COMPARATIVE EXAMPLE EMBODIMENT_ MURA CORRECTION LUT>

MURA CORRECTION VALUE Δ

| GRAY | RED | GREEN | BLUE |
|---|---|---|---|
| 0 | | | |
| 1 | | | |
| 2 | | | |
| ... | ... | ... | ... |
| 22 | | | |
| 23 | 25 | 24 | 28 |
| 24 | | 22 | |
| 25 | 27 | | |
| 26 | 26 | 23 | 25 |
| 27 | | | |
| 28 | | | 29 |
| ... | ... | ... | ... |
| 255 | | | |

DISPLAY APPARATUS, METHOD OF DRIVING THE SAME AND VISION INSPECTION APPARATUS FOR THE SAME

CROSS REFERENCE TO RELATED APPLICATIONS

This application is a Continuation of U.S. patent application Ser. No. 14/790,927, filed on Jul. 2, 2015, and claims priority from and the benefit of Korean Patent Application No. 10-2014-0177692, filed on Dec. 10, 2014, which is hereby incorporated by reference for all purposes as if fully set forth herein.

BACKGROUND

Field

Exemplary embodiments of the inventive concept relate to a display apparatus, a method of driving the display apparatus, and an inspection apparatus for the display apparatus. More particularly, example embodiments of the inventive concept relate to a display apparatus for compensating a Mura defect and a gamma difference, a method of driving the display apparatus and a vision inspection apparatus for the display apparatus.

Discussion of the Background

In general, a liquid crystal display ("LCD") panel includes a lower substrate, an upper substrate opposite to the lower substrate and an LC layer disposed between the upper substrate and the lower substrate. The lower substrate includes a pixel area defining a pixel and a peripheral area receiving a driving signal which is to be applied to the pixel.

A data line, a gate line and a pixel electrode are disposed in the pixel area. The data line extends in a first direction, the gate line extends in a second direction crossing the first direction and the pixel electrode is connected to the data line and the gate line. A first driving chip pad (such as a data driver) and a second driving chip pad (such as a gate driver) are disposed in the peripheral area. The first driving chip pad receives a data signal and the second driving chip pad receives a gate signal.

The LC panel, with the LC layer disposed between the upper substrate and the lower substrate, is tested through a visual test process which tests electrical and optical operations of the LC panel. In general, the visual test process includes testing various kinds of Mura defects (e.g. spot and line Mura defects, etc.) by a tester's eyes and removing the Mura defects using a Mura defect removal algorithm based on a test result obtained by the tester's eyes. Correction data generated through the Mura defect removal algorithm are stored at a memory in a display apparatus and then, the display apparatus corrects input data using the correction data to compensate the Mura defect.

SUMMARY OF THE INVENTION

Exemplary embodiments of the inventive concept provide a display apparatus for compensating a Mura defect and a gamma difference.

Exemplary embodiments of the inventive concept provide a method of driving the display apparatus.

Exemplary embodiments of the inventive concept provide a vision inspection apparatus for the display apparatus According to an exemplary embodiment of the inventive concept, there is provided a display apparatus. The display apparatus includes a display panel comprises a plurality of pixels, a first image data corrector configured to calculate a Mura correction value of input data based on gamma correction data of the input data, to add the Mura correction value to the input data, and to generate gamma correction data of add input data, and a data driver configured to drive the plurality of pixels based on the gamma correction data provided from the first image data corrector.

In an exemplary embodiment, the first image data corrector may include a first image corrector configured to generate gamma correction data of the input data using a first gamma look-up table ("LUT"), a Mura corrector configured to calculate a Mura correction value of the gamma correction data provided from the first image corrector, an adder configured to add the Mura correction value to the input data, and to generate added input data, and a second image corrector configured to generate gamma correction data of the added input data using the first gamma LUT.

In an exemplary embodiment, the display apparatus may further include a second image data corrector configured to generate gamma correction data of the gamma correction data generated from the second image corrector using a second gamma LUT different from the first gamma LUT.

In an exemplary embodiment, the first gamma LUT may include gamma correction data for compensating a gamma difference by the display panel.

In an exemplary embodiment, the second gamma LUT may include gamma correction data for compensating a gamma difference by a model of the display apparatus.

In an exemplary embodiment, each of the plurality of pixels may include red, green and blue sub pixels, the input data comprising red, green and blue input data.

In an exemplary embodiment, the first gamma LUT may include red, green and blue gamma correction data respectively corresponding to the red, green and blue input data.

In an exemplary embodiment, the Mural corrector may include a Mura correction LUT which comprises red, green and blue Mura correction values respectively corresponding to the red, green and blue gamma correction data.

According to an exemplary embodiment of the inventive concept, there is provided a method of driving the display apparatus. The method includes generating first gamma correction data of input data using a first gamma look-up table ("LUT"), calculating a Mura correction value of the first gamma correction data, adding the Mura correction value to the input data to generate added input data, generating second gamma correction data of the added input data using the first gamma LUT, and driving a pixel in the display panel using the second gamma correction data of the added input data.

In an exemplary embodiment, the method may further include generating third gamma correction data of the second gamma correction data using a second gamma LUT.

In an exemplary embodiment, gamma correction data stored in the first gamma LUT may correspond to a first target gamma and gamma correction data stored in the second gamma LUT may correspond to a second target gamma different from the first target gamma.

In an exemplary embodiment, each of the plurality of pixels may include red, green and blue sub pixels, the input data comprising red, green and blue input data.

In an exemplary embodiment, the first gamma LUT may include red, green and blue gamma correction data respectively corresponding to the red, green and blue input data.

In an exemplary embodiment, the Mura correction value may be calculated using a Mura correction LUT which stores red, green and blue Mura correction values respectively corresponding to the red, green and blue gamma correction data.

According to an exemplary embodiment of the inventive concept, there is provided a vision inspection apparatus for a display apparatus. The vision inspection apparatus includes a camera configured to capture a reference grayscale image of a reference grayscale displayed on a display apparatus and to output reference grayscale image data, a gamma correction calculator configured to calculate a gamma correction value of the reference grayscale based on the reference grayscale image data, and a Mura correction calculator configured to calculate a Mura correction value of the reference grayscale using the reference grayscale image data used at the gamma correction calculator.

In an exemplary embodiment, the vision inspection apparatus may further include a luminance profile calculator configured to calculate a luminance profile of the reference grayscale using the reference grayscale image data provided from the camera.

In an exemplary embodiment, the camera may be configured to capture the reference grayscale image during one interval of time, and the gamma correction value and the Mura correction value may be calculated using the reference grayscale image data of the reference grayscale image captured from the camera during one interval of time.

In an exemplary embodiment, the vision inspection apparatus may further include a gamma look-up table ("LUT") generator configured to generate a gamma LUT which stores the gamma correction value of the reference grayscale and a Mura correction LUT generator configured to generate a Mura correction LUT which stores a Mura correction value of the reference grayscale.

According to the inventive concept, the display apparatus includes LUTs respectively storing the Mura correction value and gamma correction data calculated from the vision inspection apparatus, determining a Mura correction value of input data based on the gamma correction data of the input data, and thus the gamma and Mura corrections are performed together and an artifact defect in which color is distorted may be decreased or eliminated.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein:

FIGS. 5A to 5C are conceptual diagrams illustrating a Mura correction after a gamma correction according to a comparative example embodiment;

DETAILED DESCRIPTION OF THE INVENTION

Hereinafter, the inventive concept will be explained in detail with reference to the accompanying drawings.

Figure 1:
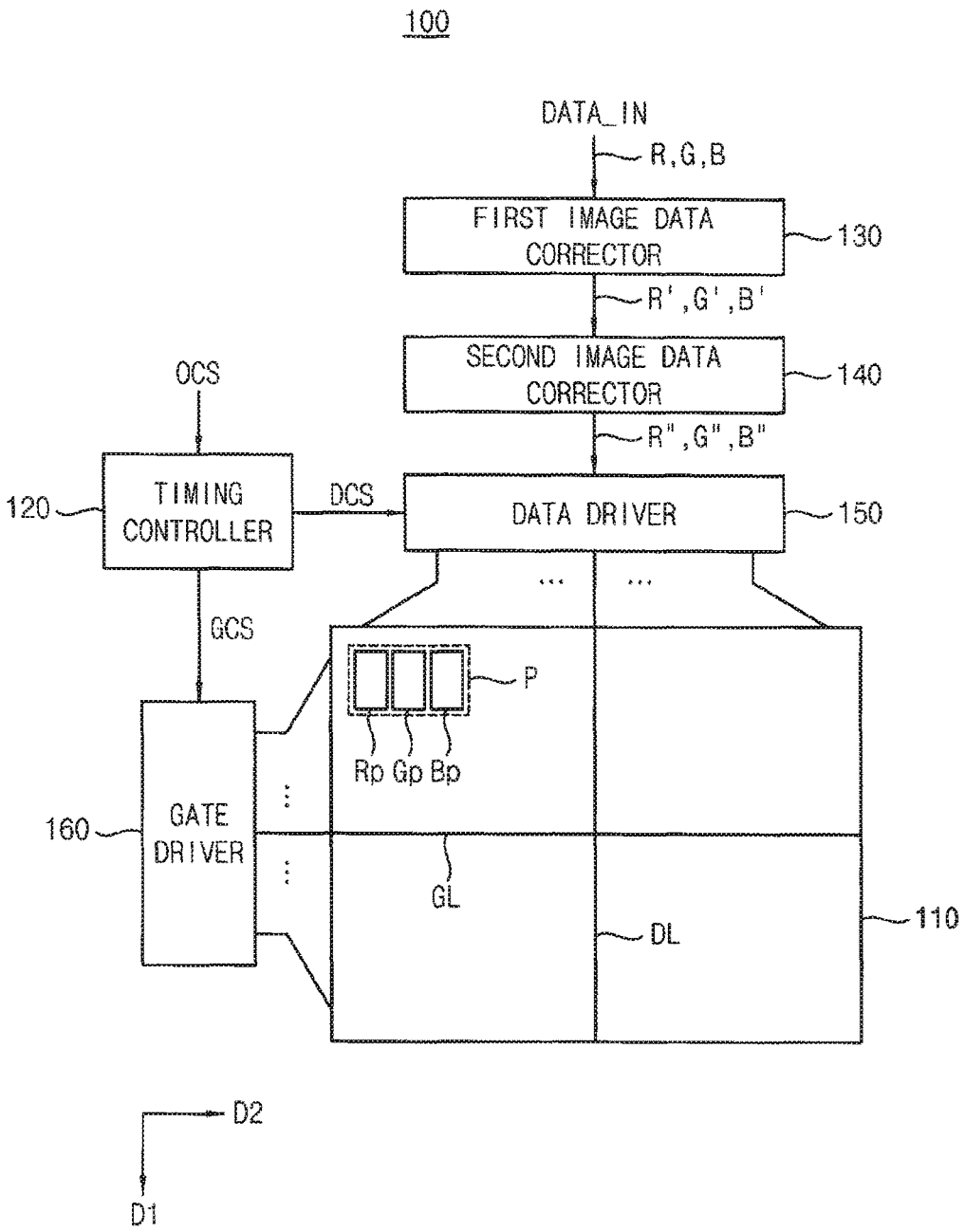
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus 100 may include a display panel 110, a timing controller 120, a first image data corrector 130, a second image data corrector 140, a data driver 150 and a gate driver 160.

The display panel 110 may include a plurality of data lines D1, a plurality of gate lines GL and a plurality of pixels P. The data lines DL extend in a first direction DL, and are connected to output terminals of the data driver 150 to receive a data voltage. The gate lines GL extend in a second direction D2 crossing the first direction D1, are connected to output terminals of the gate driver 160 to sequentially receive a gate signal. The pixels P are arranged as a matrix type and each of the pixels P may include a plurality of color sub pixels Rp, Gp and Bp. The plurality of color sub pixels Rp, Gp and Bp may include red, green and blue sub pixels Rp, Gp and Bp.

The timing controller 120 is configured to receive an original control signal OCS. The timing controller 120 is configured to generate a data control signal DCS for controlling the data driver 150 and a gate control signal GCS for controlling the gate driver 160 using the original control signal OCS.

The first image data corrector 130 is configured to perform a gamma correction and a Mura correction with respect to input data DATA_IN. The input data DATA_IN include red, green and blue data R, G and B respectively corresponding to the red, green and blue sub pixels Rp, Gp and Bp.

The first image data corrector 130 is configured to perform a color gamma correction with respect to each of the red, green and blue input data R, G and B of the input data DATA_IN using red, green, and blue gamma correction data, and then, to calculate red, green and blue Mura correction values respectively corresponding to the red, green and blue gamma correction data corrected through the color gamma correction. The first image data corrector 130 is configured to respectively add the red, green and blue Mura correction values to the red, green and blue input data R, G and B of the input data DATA_IN, and then, to perform the color gamma correction with respect to each of the added red, green and blue input data. Thus, the first image data corrector 130 is configured to generate first red, green and blue gamma correction data R', G' and B' compensating a color gamma difference and a Mura defect of the display 110.

The second image data corrector 140 is configured to perform a normal color gamma correction with respect to each of the first red, green and blue gamma correction data R', G' and B' compensating the color gamma difference and Mura defect through the first image data corrector 130 and then, to generate second red, green and blue gamma correction data R", G" and B".

For example, the color gamma correction through the first image data corrector 130 may compensate a color gamma difference according to physical difference of the display panel 110 occurring on manufacturing processes. The color gamma correction through the second image data corrector 140 may compensate a color gamma difference according to physical difference by a model of the display apparatus. Thus, a target gamma used at the first image data corrector 130 may be different from a target gamma used at the second image data corrector 140.

The second image data corrector 140 is configured to provide the data driver 150 with the second red, green and blue gamma correction data R", G" and B".

The data driver 150 is configured to convert the second red, green and blue gamma correction data R", G" and B" to red, green and blue data voltages based on the data control signal DCS and then, to provide the red, green and blue sub pixels Rp, Gp and Bp of the display panel 110 with the red, green and blue data voltages.

The gate driver 160 is configured to generate a gate signal based on the gate control signal GCS and then, to sequentially provide the gate lines of the display panel 110 with the gate signal along a scan direction.

In the display apparatus, when the Mura correction after the color gamma correction is performed, the reference grayscale used at the Mura correction is changed by the color gamma correction and thus, an artifact defect in which color is distorted, occurs by a false correction. In addition, when the color gamma correction is performed after the Mura correction is performed, the display apparatus needs a gamma correction value using a grayscale image for the color gamma correction which is re-captured through a camera. For example, a vision inspection apparatus calculates the Mura correction value using a grayscale image captured through the camera, displays a grayscale image applying the Mura correction value on the display apparatus, re-captures the grayscale image displayed on the display apparatus and then calculates the gamma correction value using the re-captured grayscale image. Thus, processes for obtaining the Mura correction value and the gamma correction value are cumbersome.

However, according to the exemplary embodiment, the display apparatus calculates the gamma correction value using the Mura correction value and thus, the color gamma and Mura corrections are performed together and the artifact defects may be decreased or eliminated.

Figure 2:
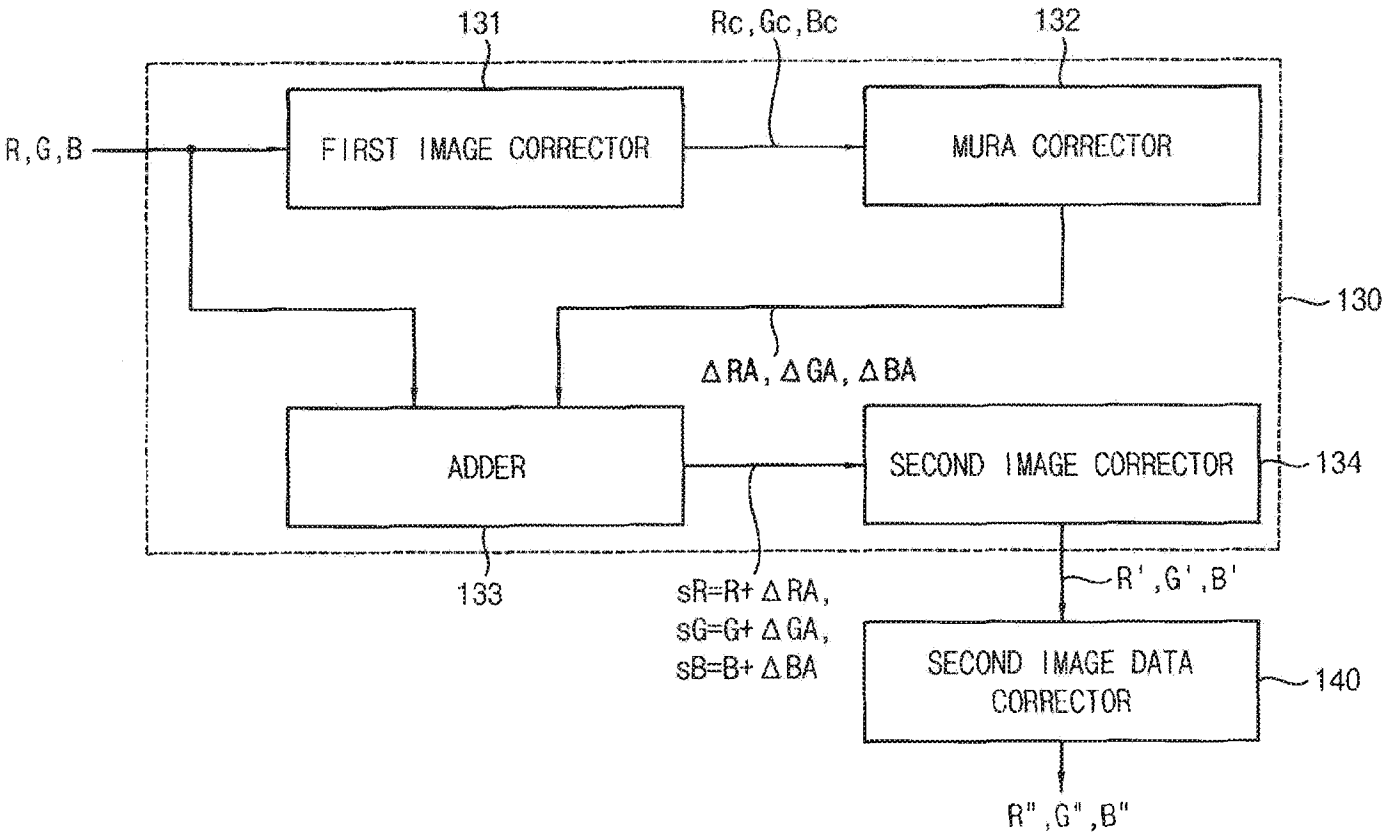
FIG. 2 is a block diagram illustrating an image data corrector of FIG. 1.
Figures 3A, 3B:
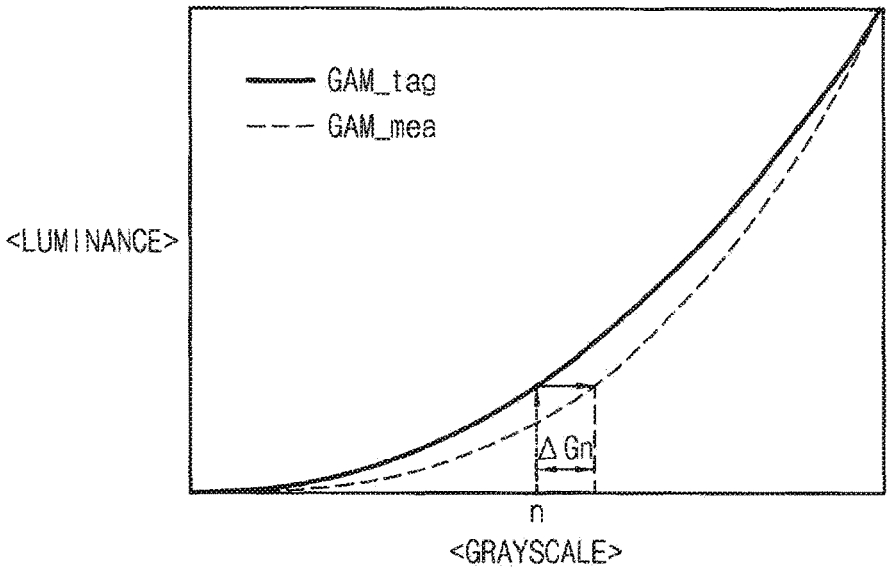
FIGS. 3A and 3B are conceptual diagrams illustrating a first image corrector of FIG. 2.
Figures 4A, 4B:
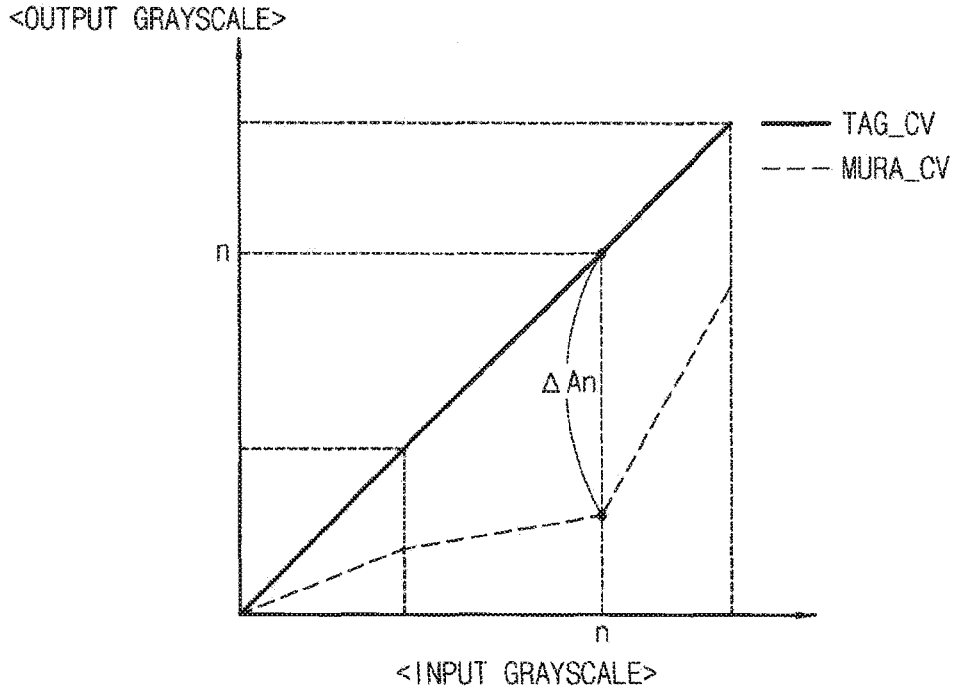
FIGS. 4A and 4B are conceptual diagrams a Mura corrector of FIG. 2.

FIG. 2 is a block diagram illustrating an image data corrector of FIG. 1. FIGS. 3A and 3B are conceptual diagrams illustrating a first image corrector of FIG. 2. FIGS. 4A and 4B are conceptual diagrams a Mura corrector of FIG. 2.

Referring to FIGS. 1 and 2, the first image data corrector 130 may include a first image corrector 131, a Mura corrector 132, an adder 133 and a second image corrector 134.

The first image corrector 131 is configured to store red, green and blue gamma correction data corresponding to red, green and blue data R, G and B of the input data as a look up table ("LUT") type. For example, the first image corrector 131 may include a first RGB-gamma LUT RGB_LUT1. The first RGB-gamma LUT RGB_LUT1 stores red gamma correction data Rc corresponding to red input data R, green gamma correction data Gc corresponding to green input data G and blue gamma correction data Bc corresponding to blue input data B.

The red, green and blue gamma correction data Rc, Gc and Bc stored in the first RGB-gamma LUT RGB_LUT1 may be calculated by a vision inspection apparatus.

Referring to FIGS. 3A and 3B, a vision inspection apparatus is configured to calculate a gamma correction value ΔGn of an n-grayscale using a measured gamma curve GAM_mea which is calculated by a grayscale image displayed on the display apparatus 100 and a target gamma curve GAM_tag, and to calculate red, green and blue gamma correction values ΔRGn, ΔGGn, and ΔBGn of the n-grayscale based on the gamma correction value ΔGn of the n-grayscale. The red, green and blue gamma correction values ΔRGn, ΔGGn and ΔBGn are added to the red, green and blue input data R, G and B of the n-grayscale and thus, red, green and blue gamma correction data n-FΔRGn, n-F ΔGGn and n-F ΔBGn of the n-grayscale are calculated. The red, green and blue gamma correction data n-FΔRGn, n-F ΔGGn and n-F ΔBGn of the n-grayscale may be stored as an LUT type.

The first image corrector 131 is configured to generate gamma correction data Rc, Gc and Bc corresponding to the red, green and blue input data R, G and B using the first RGB-gamma LUT RGB_LUT1 and to provide the Mura corrector 132 with the gamma correction data Rc, Gc and Bc.

The Mura corrector 132 may include a Mura correction LUT which stores red, green and blue Mura correction values corresponding to input data provided from the first image corrector 131. According to the exemplary embodiment, the Mura corrector 132 is configured to generate red, green and blue Mura correction values ΔRA, ΔGA and ΔBA respectively corresponding to the gamma correction data Rc, Gc and Bc received from the first image corrector 131.

Referring to FIG. 4A, the vision inspection apparatus is configured to calculate a Mura correction value ΔAn of the n-grayscale using a Mura grayscale curve MURA_CV which is calculated by a grayscale image displayed on the display apparatus 100 and a target grayscale curve TAG_CV, and to calculate red, green and blue Mura correction values ΔRAn, ΔGAn and ΔBan based on the Mura correction value ΔAn of the n-grayscale. The red, green and blue Mura correction values ΔRAn, ΔGAn and ΔBan corresponding to the n-grayscale are stored as the LUT type.

The adder 133 is configured to add the red, green and blue Mura correction values ΔRA, ΔGA and ΔBA provided from the Mura corrector 132 to the red, green and blue input data R, G and B, and then, to provide the second image corrector 134 with added red, green and blue input data sR=R+ΔRA, sG=G+ΔGA and sB=B+ΔBA.

The second image corrector 134 may include the first RGB-gamma LUT RGB_LUT1 which is the same as the first RGB-gamma LUT RGB_LUT1 used at the first image corrector 131. The second image corrector 134 is configured to generate gamma correction data Rc', Gc' and Bc' respectively corresponding to the added red, green and blue input data sR, sG and sB provided from the adder 133 using the first RGB-gamma LUT RGB_LUT1 and then, to output the gamma correction data Rc', Gc' and Bc' as first red, green and blue gamma correction data R', G' and B'.

The second image data corrector 140 may include a second RGB-gamma LUT RGB_LUT2 which is different from the first RGB-gamma LUT RGB_LUT1. The second image data corrector 140 generates second red, green and blue gamma correction data R", G" and B" that are color gamma correction data, respectively corresponding to the first red, green and blue gamma correction data R', G' and B' using the second RGB-gamma LUT RGB_LUT2.

Figure 5C:
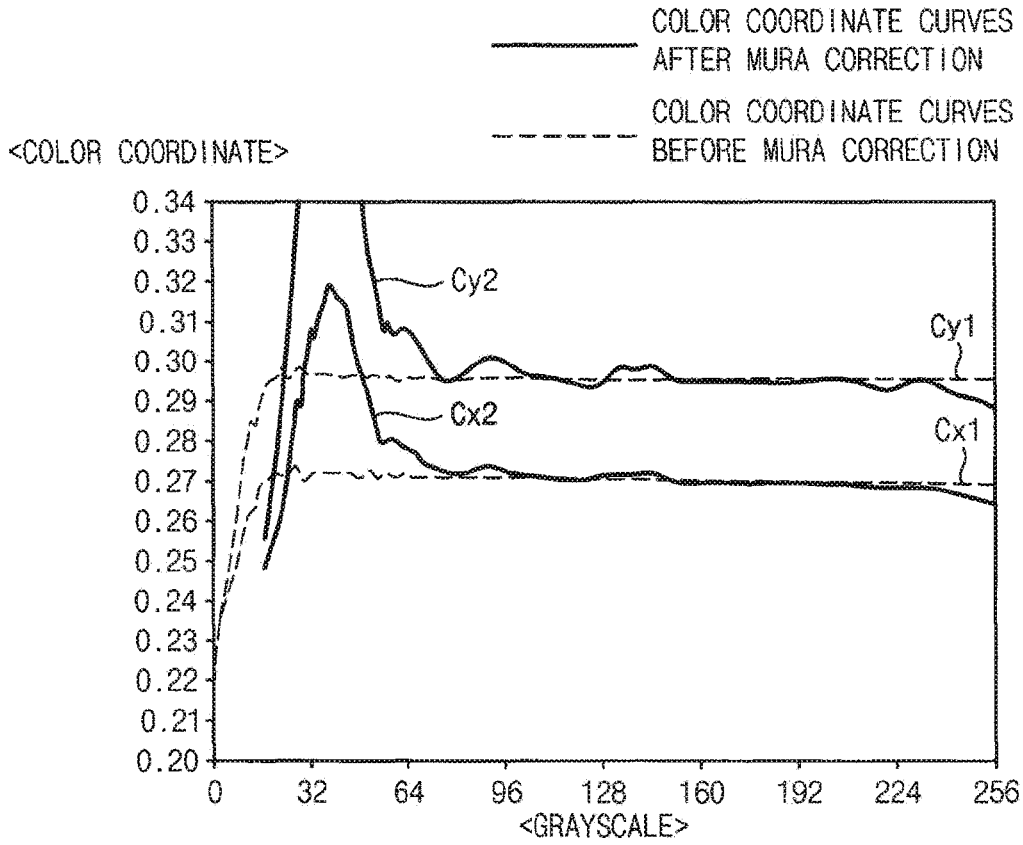
Figure 6:
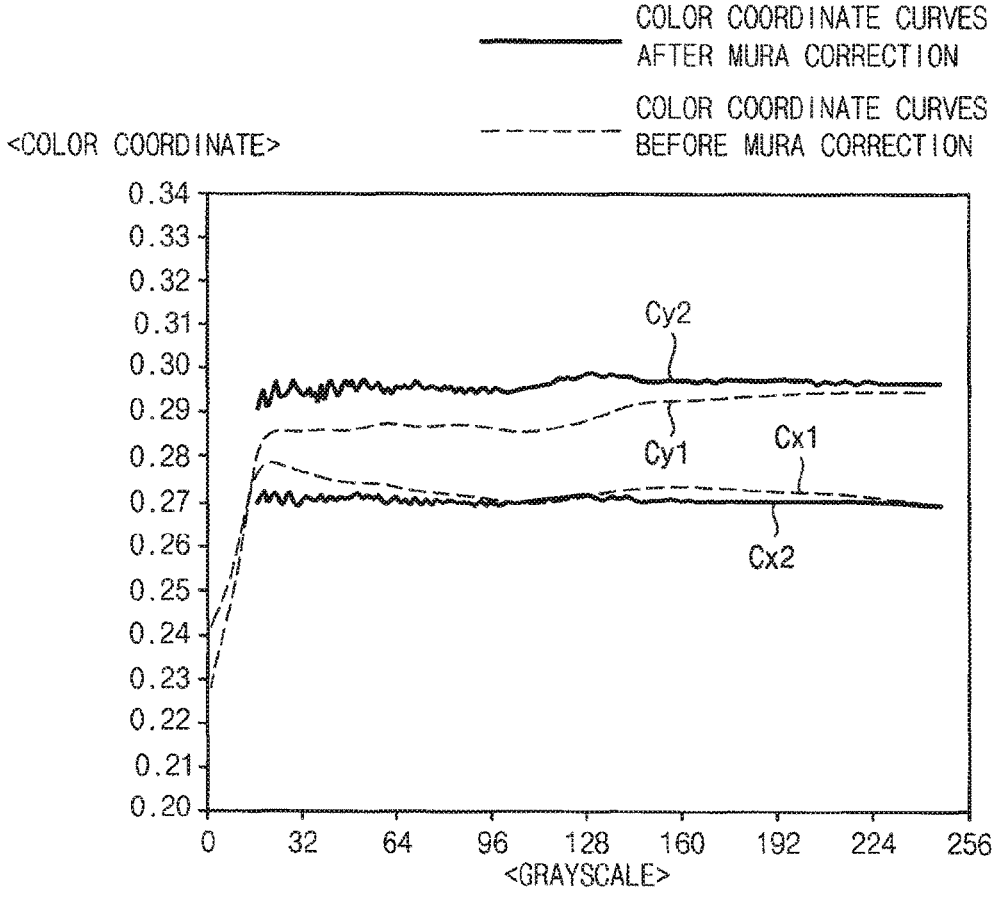
FIG. 6 is a graph illustrating a white balance by the image data corrector according to an exemplary embodiment.

FIGS. 5A to 5C are conceptual diagrams illustrating a Mura correction after a gamma correction according to a comparative example embodiment. FIG. 6 is a graph illustrating a white balance by the image data corrector according to an exemplary embodiment.

FIG. 5A is a gamma LUT according to a comparative example embodiment, FIG. 5B is a Mura correction LUT according to the comparative example embodiment and FIG. 5C is a graph illustrating a white balance through a gamma and Mura corrections according to the comparative example embodiment.

Referring to FIGS. 5A to 5C, the gamma LUT stores red, green and blue gamma correction data applying a gamma correction value corresponding to the red, green and blue input data and the Mura correction LUT stores red, green and blue Mura correction data applying a Mura correction value corresponding to the red, green and blue input data.

According to the comparative example embodiment, the input data of a 23-grayscale is performed the Mura correction after the gamma correction. For example, firstly, the input data of the 23-grayscale is received, and then the gamma correction is performed with respect to the input data of the 23-grayscale using the gamma LUT. Based on the gamma LUT, red, green and blue input data of the 23-grayscale are corrected into red gamma correction data of a 25-grayscale, green gamma correction data of a 24-grayscale and blue gamma correction data of a 28-grayscale, respectively.

Then, the Mura correction is performed with respect to the red gamma correction data of the 25-grayscale, the green gamma correction data of the 24-grayscale and the blue gamma correction data of the 28-grayscale using the Mura correction LUT. Based on the Mura correction LUT, the red gamma correction data of the 25-grayscale, the green gamma correction data of the 24-grayscale and the blue gamma correction data of the 28-grayscale are corrected into red Mura correction data of a 27-grayscale, green Mura correction data of a 22-grayscale and blue Mura correction data of a 29-grayscale, respectively.

According to a normal Mura correction, when the Mura correction value corresponding to the input data of the 23-grayscale is a 3-grayscale, the input data of the 23-grayscale is corrected into Mura correction data of a 26-grayscale which equals the 3-grayscale that is the Mura correction value plus the 23-grayscale of the input data. Thus, the red input data is corrected into red Mura correction data of a 26-grayscale, the green input data is corrected into green Mura correction data of a 23-grayscale and the blue input data is corrected into blue Mura correction data of a 25-grayscale.

However, according to the comparative example embodiment, when the Mura correction after the gamma correction is performed, the input data that is a reference data for the Mura correction are changed by the gamma correction and thus, an artifact defect in which color is distorted, occurs by a false correction.

Referring to FIG. 5C, a white balance according to color coordinate curve after the Mura correction Cy2 and Cx2 is distorted rather than a white balance according to color coordinate curve before the Mura correction Cy1 and Cx1.

Thus, according to the exemplary embodiment, the display apparatus may further include the adder 133 and the second image corrector 134 in order to decrease a distortion of the white balance.

According to the exemplary embodiment, referring to FIGS. 2 and 6, the adder 133 is configured to add the red, green and blue Mura correction values ΔRA, ΔGA and ΔBA provided from the Mura corrector 132 to the red, green and blue input data R, G and B, respectively, and to provide the second image corrector 134 with added red, green and blue input data sR=R+ΔRA, sG=G+ΔGA and sB=B+ΔBA. Thus, the Mura correction value may be determined by the gamma correction value.

The second image corrector 134 may include the first RGB-gamma LUT RGB_LUT1 which is the same as the first RGB-gamma LUT RGB_LUT1 used at the first image corrector 131. The second image corrector 134 is configured to generate red, green and blue gamma correction data Rc', Gc' and Bc' respectively corresponding to the added red, green and blue input data sR, sG and sB provided from the adder 133 using the first RGB-gamma LUT RGB_LUT1, and to output the red, green and blue gamma correction data Rc', Gc' and Bc' as the first red, green and blue gamma correction data R', G' and B'. Thus, the display apparatus according to the exemplary embodiment performs the color gamma correction with respect to the added red, green and blue input data sR, sG and sB which are the input data compensating the Mura defect such that an artifact defect in which color is distorted, may be decreased or eliminated.

The second image data corrector 140 may include the second RGB-gamma LUT RGB_LUT2 which is different from the first RGB-gamma LUT RGB_LUT1. The second image data corrector 140 is configured to perform a normal color gamma correction and thus, generates the second red, green and blue gamma correction data R", G" and B" corresponding to the first red, green and blue gamma correction data R', G' and B' using the second RGB-gamma LUT RGB_LUT2.

Referring to FIG. 6, color coordinate curve before correction Cy1 and Cx1 is a color coordinate curve when the color gamma correction is performed by only the first image data corrector 130. Color coordinate curve after correction Cy2 and Cx2 is a color coordinate curve when the color gamma correction is performed by the second image data correctors 140 after the color gamma and Mura corrections by the first image data corrector 130.

As shown in FIG. 6, referring to the color coordinate curve before correction Cy1 and Cx1, a white balance according to grayscales is generally maintained. In addition, referring to the color coordinate curve after correction Cy2 and Cx2, a white balance according to grayscales is conspicuously maintained rather than the white balance of the color coordinate curve before correction Cy1 and Cx1.

In the display apparatus, when the Mura correction after the color gamma correction is performed, the reference grayscale used at the Mura correction is changed by the color gamma correction and thus, an artifact defect in which color is distorted, occurs by a false correction. In addition, when the color gamma correction after the Mura correction is performed, the display apparatus needs a gamma correction value using a grayscale image re-captured through a camera. For example, a vision inspection apparatus calculates the Mura correction value using a grayscale image captured through the camera, displays a grayscale image applying the Mura correction value on the display apparatus, re-captures the grayscale image displayed on the display apparatus and then calculates the gamma correction value using a re-captured grayscale image. Thus, processes for obtaining the Mura correction value and the gamma correction value are cumbersome.

However, according to the exemplary embodiment, the display apparatus calculates the gamma correction value using the Mura correction value and thus, the color gamma and Mura corrections are performed together and the artifact defects may be decreased or eliminated.

Figure 7:
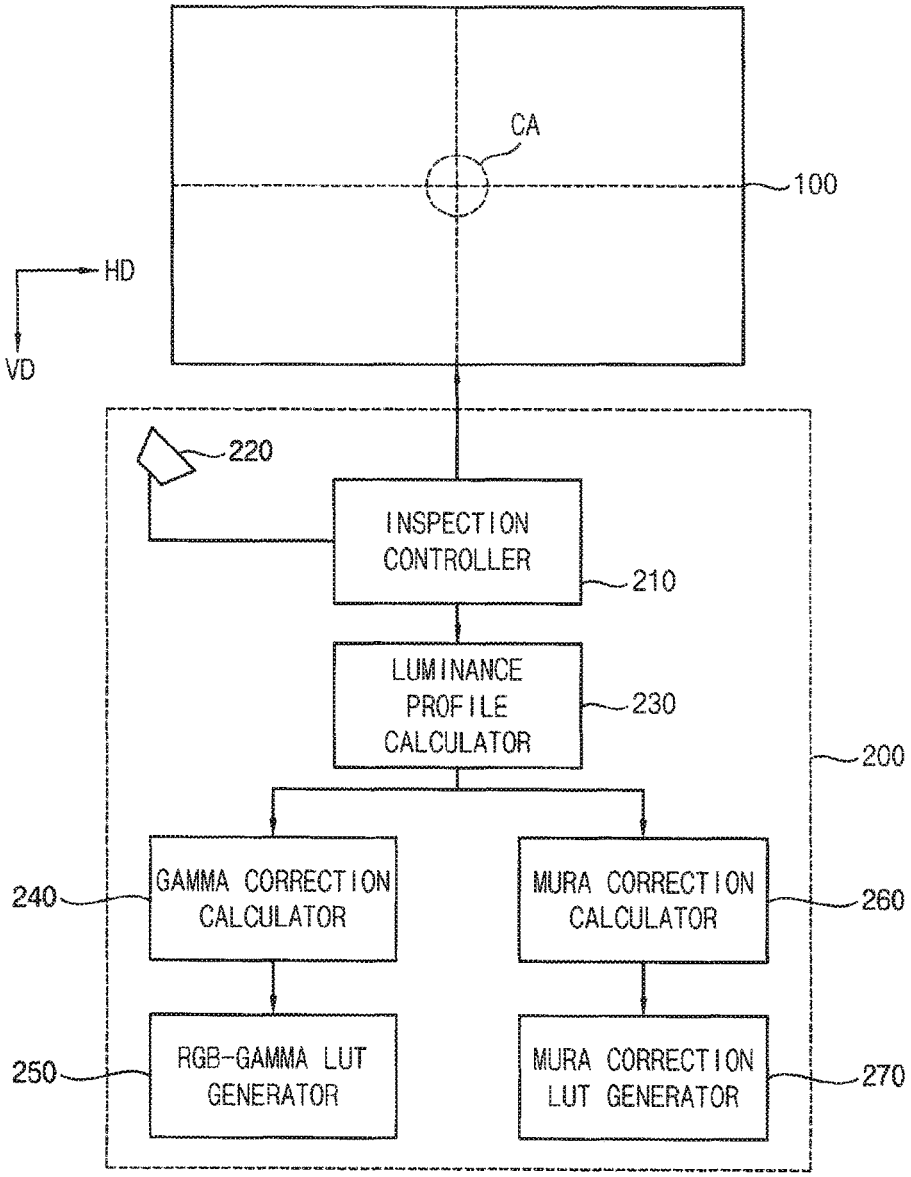
FIG. 7 is a block diagram illustrating a vision inspection apparatus according to an exemplary embodiment.
Figure 8:
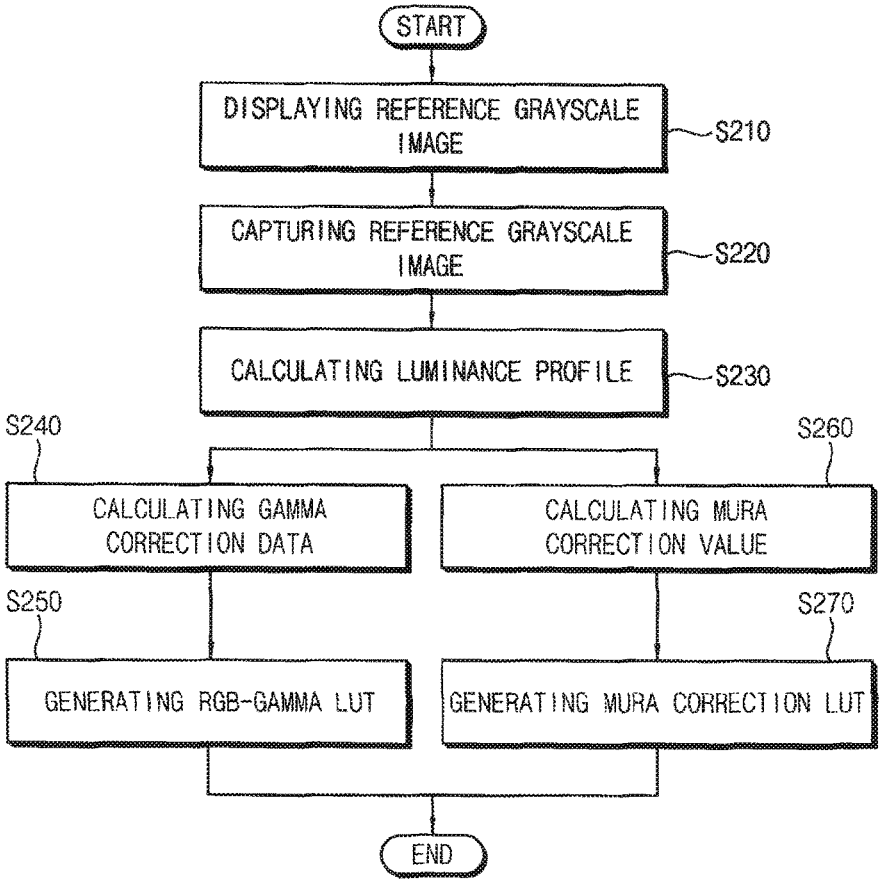
FIG. 8 is a flow chart illustrating a method of driving the vision inspection apparatus of FIG. 7.

FIG. 7 is a block diagram illustrating a vision inspection apparatus according to an exemplary embodiment. FIG. 8 is a flow chart illustrating a method of driving the vision inspection apparatus of FIG. 7.

Referring to FIGS. 7 and 8, the vision inspection apparatus 200 is configured to calculate a gamma correction value for compensating a gamma difference of the display apparatus 100 and a Mura correction value for compensating a Mura defect of the display apparatus 100, respectively.

The vision inspection apparatus 200 may include an inspection controller 210, a camera 220, a luminance profile calculator 230, a gamma correction calculator 240, a RGB-gamma LUT generator 250, a Mura correction calculator 260 and a Mura correction LUT generator 270.

The inspection controller 210 is configured to generally control the vision inspection apparatus 200. For example, the inspection controller 210 is configured to display a plurality of reference grayscale images corresponding to a plurality of reference grayscales which is sampled from total grayscales, on the display apparatus 100 (Step S210). The plurality of reference grayscales may include a 0-grayscale, a 50-grayscale, a 100-grayscale, a 150-grayscale, a 200-grayscale and a 250-grayscale among the total 255 grayscales, but not limited thereto.

The camera 220 is configured to capture each of the plurality of reference grayscale images displayed on the display apparatus 100 (Step S220). The camera 220 is configured to provide the luminance profile calculator 230 with a plurality of reference grayscale image data corresponding to the plurality of reference grayscale images. The camera 220 may include a charge-coupled ("CCD") camera and a complementary metal-oxide-semiconductor ("CMOS") camera, for example.

The luminance profile calculator 230 is configured to analyze the plurality of reference grayscale image data and to generate a plurality of luminance profiles corresponding to the plurality of reference grayscales (Step S230). The luminance profiles may include a luminance profile corresponding to at least one of a horizontal direction HD and a vertical direction VD of the display apparatus 100. For example, the luminance profile generator 230 may be configured to generate the luminance profiles of the horizontal direction HD for compensating vertical Mura defect such as a vertical line on the display apparatus 100, and alternatively, the luminance profile generator 230 may be configured to generate the luminance profiles of vertical direction VD for compensating horizontal Mura defects such as a horizontal line on the display apparatus 100.

The gamma correction calculator 240 is configured to generate a measured gamma curve GAM_mea of a predetermined area in the display apparatus 100 using the plurality of luminance profiles corresponding to the plurality of reference grayscales. For example, the gamma corrector 240 is configured to a measured gamma curve of a central area CA in the display apparatus 100 as shown in FIG. 3A.

As shown in FIG. 3A, the gamma correction calculator 240 is configured to calculate a gamma correction value ΔGn of an n-grayscale using a measured gamma curve GAM_mea which is calculated by a grayscale image displayed on the display panel 110 and a target gamma curve GAM_tag, and to calculate red, green and blue gamma correction values ΔRGn, ΔGGn, and ΔBGn of the n-grayscale based on the gamma correction value ΔGn of the n-grayscale. The red, green and blue gamma correction values ΔRGn, ΔGGn and ΔBGn are added to the red, green and blue input data R, G and B of the n-grayscale and thus, red, green and blue gamma correction data n+ΔRGn, n+ΔGGn and n+ΔBGn of the n-grayscale are calculated (Step S240).

The RGB-gamma LUT generator 250 is configured to store the red, green and blue gamma correction data n+ΔRGn, n+ΔGGn and n+ΔBGn of the n-grayscale corresponding to the input data of the n-grayscale as the LUT type.

As show in FIG. 3B, the RGB-gamma LUT generator 250 is configured to generate an RGB-gamma LUT which stores store the red, green and blue gamma correction data n+ΔRGn, n+ΔGGn and n+ΔBGn of the n-grayscale corresponding to the input data of the n-grayscale as the LUT type (Step S250). The RGB-gamma LUT is stored in the first and second image correctors 131 and 134 as shown in FIG. 2.

The Mura correction calculator 260 is configured to calculate a plurality of Mura correction values corresponding to each of the plurality of reference grayscales using the plurality of luminance profiles provided from the luminance profile calculator 230 and the plurality of target luminance profiles which is preset.

As shown in FIG. 4A, the Mura correction calculator 260 is configured to calculate a Mura correction value ΔAn of the n-grayscale using a Mura grayscale curve MURA_CV which is calculated using the plurality of luminance profiles and a target grayscale curve TAG_CV which is calculated using the plurality of target luminance profiles, and to calculate red, green and blue Mura correction values ΔRAn, ΔGAn and ΔBan based on the Mura correction value ΔAn of the n-grayscale (Step S260).

The Mura correction LUT generator 270 is configured to generate a Mura correction LUT which stores the red, green and blue Mura correction values ΔRAn, ΔGAn and ΔBan of the n-grayscale calculated from the Mura correction calculator 260 as the LUT type (Step S270). The Mura correction LUT is stored in the Mura corrector 132 as shown in FIG. 2.

According to the exemplary embodiment, the camera 220 captures the plurality of reference grayscale images displayed on the display apparatus during one interval of time, and then the gamma correction value and the Mura correction value are calculated using the reference grayscale image data of the reference grayscale images captured from the camera during one interval of time.

For example, the gamma correction calculator 240 and the Mura correction calculator 260 are configured to respectively calculate the gamma correction values and the Mura correction values based on same reference grayscale image data provided from the camera. Thus, the vision camera apparatus according to the exemplary embodiment may simplify inspection processes such as displaying the reference grayscale images, capturing displayed reference grayscale images, calculating correction values and so on.

As described above, according to exemplary embodiments, the display apparatus includes LUTs respectively storing the Mura correction value and gamma correction data calculated from the vision inspection apparatus, determining a Mura correction value of input data based on the gamma correction data of the input data, and thus the gamma and Mura corrections are performed together and an artifact defect in which color is distorted may be decreased or eliminated.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A method of driving a display apparatus comprising:

generating first gamma correction data of input data using a first gamma look-up table ("LUT");

determining a Mura correction value of the first gamma correction data;

adding the Mura correction value to the input data to generate added input data;

generating second gamma correction data of the added input data using the first gamma LUT; and driving a pixel in the display panel using the second gamma correction data of the added input data, wherein:

the Mura correction value is determined after the gamma correction data is generated; and the generating of the added input data is performed prior to any gamma correction being performed on the input data.

2. The method of claim 1, further comprising:

generating third gamma correction data of the second gamma correction data using a second gamma LUT, wherein:

the gamma correction data generated by the first image corrector is only used as input into the Mura corrector and is not used to perform gamma correction on the input data; and the gamma correction data generated by the second image corrector is used to perform gamma correction on the added input data.

3. The method of claim 2, wherein gamma correction data stored in the first gamma LUT corresponds to a first target gamma and gamma correction data stored in the second gamma LUT corresponds to a second target gamma different from the first target gamma.

4. The method of claim 1, wherein no gamma correction to the input data is performed prior to the generating of the added input data.

5. The method of claim 4, wherein:

each of the plurality of pixels comprises red, green, and blue sub pixels, the input data comprising red, green, and blue input data;

the Mura correction value is determined using a Mura correction LUT which stores red, green, and blue Mura correction values respectively corresponding to the red, green, and blue gamma correction data; and the display apparatus is an LCD display device.

* * * * *